US011230910B2

(12) United States Patent
Ismail et al.

(10) Patent No.: US 11,230,910 B2
(45) Date of Patent: Jan. 25, 2022

(54) DOWNHOLE FLOW CONTROL DEVICE AND METHOD

(71) Applicant: Swellfix UK Limited, Westhill (GB)

(72) Inventors: Ismarullizam Mohd Ismail, Aberdeen (GB); Annabel Green, Huntly (GB); Oliver Webster, Torphins (GB); Damien Gerard Patton, Huntly (GB); Stephen Garden, Inverurie (GB)

(73) Assignee: SWELLFIX UK LIMITED, Aberdeenshire (GB)

( * ) Notice: Subject to any disclaimer, the term of this patent is extended or adjusted under 35 U.S.C. 154(b) by 0 days.

(21) Appl. No.: 16/482,136

(22) PCT Filed: Jan. 30, 2018

(86) PCT No.: PCT/GB2018/050267
§ 371 (c)(1),
(2) Date: Jul. 30, 2019

(87) PCT Pub. No.: WO2018/142118
PCT Pub. Date: Aug. 9, 2018

(65) Prior Publication Data

US 2020/0003034 A1 Jan. 2, 2020

(30) Foreign Application Priority Data

Jan. 31, 2017 (GB) ..... 1701590

(51) Int. Cl.
*E21B 43/12* (2006.01)
*E21B 34/08* (2006.01)
(Continued)

(52) U.S. Cl.
CPC ..... *E21B 43/12* (2013.01); *E21B 34/08* (2013.01); *E21B 43/14* (2013.01); *E21B 43/24* (2013.01); *E21B 43/08* (2013.01)

(58) Field of Classification Search
CPC ..... E21B 34/08; E21B 43/12; E21B 43/14; E21B 43/24; E21B 43/08
See application file for complete search history.

(56) References Cited

U.S. PATENT DOCUMENTS 5,785,124 A * 7/1998 Hisaw ..... E21B 23/01 166/105
2011/0011590 A1* 1/2011 Mathiesen ..... E21B 43/162 166/305.1
(Continued)

FOREIGN PATENT DOCUMENTS

EP 2333235 A1 6/2011
EP 2663733 A2 11/2013
(Continued)

OTHER PUBLICATIONS

Written Opinion of the International Searching Authority PCT/ISA/237 for International Application No. PCT/GB2018/050267 dated Apr. 24, 2018.
(Continued)

*Primary Examiner* — Dany E Akakpo
(74) *Attorney, Agent, or Firm* — Harness, Dickey & Pierce, P.L.C.

(57) ABSTRACT

A downhole flow control device comprises a body locatable within a wall of a tubular, wherein the body defines a flow path therethrough to accommodate flow in reverse first and second directions between internal and external locations of the tubular in use. The downhole flow control device further comprises a regulator member mounted within the body and being moveable between first and second positions in accordance with flow direction through the body. The regulator member is locatable in the first position during flow through the body in the first direction to provide a first restriction to flow. The regulator member is locatable in the second
(Continued)

position during flow through the body in the second direction to provide a second restriction to flow.

24 Claims, 4 Drawing Sheets

(51) Int. Cl.
*E21B 43/14* (2006.01)
*E21B 43/24* (2006.01)
*E21B 43/08* (2006.01)

(56) References Cited

U.S. PATENT DOCUMENTS

2013/0008513 A1 1/2013 Aakre et al.
2014/0027123 A1* 1/2014 Organ ..... E21B 41/0007 166/339
2016/0053575 A1 2/2016 Grubert

FOREIGN PATENT DOCUMENTS

WO WO-2008143522 A1 11/2008
WO WO-2016059501 A1 4/2016

OTHER PUBLICATIONS

International Search Report PCT/ISA/210 for International Application No. PCT/GB2018/050267 dated Apr. 24, 2018.
United Kingdom Search Report from the Intellectual Property Office for Application No. GB1701590.0 dated May 11, 2017.
International Preliminary Report on Patentability dated Aug. 15, 2019 for corresponding International Application No. PCT/GB2018/050267.

* cited by examiner

DOWNHOLE FLOW CONTROL DEVICE AND METHOD

CROSS-REFERENCE TO RELATED APPLICATIONS

This application is a national phase under 35 U.S.C. § 371 of PCT International Application No. PCT/GB2018/050267 which has an International filing date of Jan. 30, 2018, which claims priority to Great Britain Application No. 1701590.0, filed Jan. 31, 2017, the entire contents of each of which are hereby incorporated by reference.

FIELD

The present disclosure relates to a downhole flow control device and uses thereof in oil and gas operations.

BACKGROUND

Multi-zone wellbore completions often include downhole flow control devices which assist to provide a desired inflow or outflow profile across the completion. For example, inflow control devices may be arranged to provide a greater flow restriction or choking effect in high permeability formation zones relative to lower permeability zones, thus allowing a more even production profile to be achieved. Such flow control may assist to prevent or minimise early water breakthrough in some zones, for example. This concept of flow control is well known in the art, and the principles can also be utilised to provide a desired injection profile.

Many wellbore operations may require the capability to reverse flow, for example between cycles or periods of injection and production. It might be desirable to provide a different restriction to flow during production and injection phases, which may not be possible with fixed restriction flow control devices. For example, some applications may require increased restriction to flow during periods of production relative to periods of injection, or vice versa. Further, while flow in one direction might desirably be restricted or choked, reverse flow may be preferred with minimal restriction or choking.

SUMMARY

In one aspect of the present disclosure there is provided a downhole flow control device, comprising:

- a body locatable within a wall of a tubular, wherein the body defines a flow path therethrough to accommodate flow in reverse first and second directions between internal and external locations of the tubular in use;
- a regulator member mounted within the body and being moveable between first and second positions in accordance with flow direction through the body, wherein the regulator member is locatable in the first position during flow through the body in the first direction to provide a first restriction to flow, and the regulator member is locatable in the second position during flow through the body in the second direction to provide a second restriction to flow, wherein the first and second restrictions to flow are different.

Accordingly, the flow control device accommodates flow in reverse directions through the flow path, with a change in flow direction (for example as a result of switching from production to injection, or vice versa) causing the flow control device to reconfigure to provide a change in the restriction to flow. Such a change in restriction to flow may be achieved autonomously, by movement of the regulator member in response to the change in flow direction. This autonomous change in flow restriction may avoid or minimise requirement for complex control and actuator systems.

The flow control device may thus provide a different restriction to flow depending on flow direction, which may improve functionality and suitability for a wider range of operations covering both injection and production, for example.

In use, the flow control device may provide a degree of flow control (for example by providing a choking effect) of fluid flowing into an associated tubular from an external location via the flow control device (for example in production operations), and/or fluid flowing from the associated tubular into an external location via the flow control device (for example in injection operations). In some embodiments the external location may be defined by a wellbore annulus, a subterranean formation, or the like.

One or both of the first and second restrictions to flow may provide a choking effect to fluid flowing through the flow control device. One or both of the first and second restrictions to flow may function to establish a back pressure in fluid flowing through the flow control device.

The first and second restrictions to flow may be selected in accordance with a user preference, for example in accordance with well design requirements and protocols, such as according to desired inflow and/or outflow profiles across a length of an associated well, drawdown requirements and the like. The first and second restrictions to flow may be selected independently of each other.

In one example the first restriction to flow may be larger than the second restriction to flow. That is, the first restriction to flow may provide a larger choking effect to flow. In such an arrangement a greater choking effect may be provided during flow in the first direction than during flow in the second direction.

In an alternative example the second restriction to flow may be larger than the first restriction to flow.

The flow control device may be arranged such that the first direction defines inflow (e.g., production) into an associated tubular, and the second direction defines outflow (e.g., injection) from an associated tubular. Alternatively, the flow control device may be arranged such that the first direction defines outflow (e.g., injection) from an associated tubular, and the second direction defines inflow (e.g., production) into an associated tubular.

The flow control device may be arranged, for example oriented, relative to the associated tubular, in accordance with user preference, for example to ensure the first and second restrictions to flow are associated with respective desired flow directions, such as inflow and outflow.

The regulator member may be located within a pocket formed within the body. The pocket may form part of the flow path through the body.

The flow control device may comprise a first opening arrangement for permitting flow into or from the flow path of the body, depending on flow direction. In one example the first opening arrangement may define a fluid inlet during flow in the first direction, and a fluid outlet during flow in the second direction. The reverse may be provided.

The first opening arrangement may be provided or formed within, for example directly within, the body.

The body may comprise an interface for a tool.

The first opening arrangement may comprise at least one flow port. The at least one flow port may be provided in an axial direction, for example with respect to a centre (e.g., longitudinal) axis of the body. The at least one flow port may be provided in a radial direction, for example with respect to a centre (e.g., longitudinal) axis of the body. The at least one flow port may be provided in an oblique direction, for example with respect to a centre (e.g., longitudinal) axis of the body.

In one example the first opening arrangement may comprise a plurality of flow ports. The plurality of flow ports may comprise at least one axial flow port. The at least one axial flow port may be coaxial with the flow path through the body. The at least one flow port may be laterally offset from a central axis of the body.

The plurality of flow ports of the first opening arrangement may comprise a plurality of axial flow ports. A plurality of circumferentially arranged flow ports may be provided (e.g. circumferentially arranged axial flow ports). The plurality of circumferentially arranged axial flow ports may be arranged around a central axial flow port.

The plurality of flow ports of the first opening arrangement may comprise at least one radial flow port. The plurality of flow ports may comprise a plurality of circumferentially arranged radial flow ports.

The plurality of flow ports of the first opening arrangement may comprise at least one axial flow port and at least one radial flow port. In one example the plurality of flow ports may comprise a central axial flow port and a plurality of radial flow ports arranged circumferentially around the central axial flow port. At least one or each of the plurality of flow ports may be located in a recessed region. Such a recessed region may provide an interface for a tool.

At least one flow port of the first opening arrangement may be obliquely aligned relative to a centre (e.g., longitudinal) axis of the body.

The first opening arrangement may be selected to provide a flow area which provides minimal restriction to flow. The first opening arrangement may define a lower restriction to flow than both the first and second restrictions to flow. That is, the first opening arrangement may not contribute, or provide minimal contribution to, either the first or second restrictions to flow.

The flow control device may comprise a second opening arrangement for permitting flow into or from the flow path of the body, depending on flow direction. In one example the second opening arrangement may define a fluid outlet during flow in the first direction, and a fluid inlet during flow in the second direction. The reverse may be provided.

The second opening arrangement may comprise at least one flow port. The at least one flow port may comprise an orifice. The at least one flow port may be provided in an axial direction, for example with respect to a centre (e.g., longitudinal) axis of the body. The at least one flow port may be provided in a radial direction, for example with respect to a centre (e.g., longitudinal) axis of the body. The at least one flow port may be provided in an oblique direction, for example with respect to a centre (e.g., longitudinal) axis of the body.

In one example the second opening arrangement may comprise a plurality of flow ports, which may be one or a combination of axial, radial and obliquely aligned.

The second opening arrangement may comprise a single flow port. The single flow port may be an axial flow port, for example aligned with a central axis of the body.

The second opening arrangement may be provided or formed within, for example directly within, the body.

The second opening arrangement may be provided on a nozzle mounted on the body. The nozzle may comprise a disk mounted within the body. The nozzle may be press-fitted, shrink fitted, bonded, welded, threadedly connected (e.g. screwed) or the like within the body. The nozzle may be replaceable. The replaceable nature of the nozzle may permit redress operations, for example to replace an eroded nozzle. The replaceable nature of the nozzle may permit a user to more appropriately provide a desired size or form of second opening arrangement.

The second opening arrangement may provide or establish the second restriction to flow. That is, during flow in the second direction the second opening arrangement may be responsible for the second restriction to flow. In one example where the second opening arrangement is provided in a nozzle, the second restriction to flow may be provided in accordance with appropriate selection of the nozzle. The flow area defined by the second opening arrangement may define the second restriction to flow.

The regulator member may comprise a regulator opening arrangement providing fluid communication through the regulator member. The regulator opening arrangement may provide or establish the first restriction to flow. That is, during flow in the first direction the regulator opening arrangement may be responsible for the first restriction to flow. The flow area defined by the regulator opening arrangement may define the first restriction to flow.

The regulator opening arrangement may comprise at least one flow port extending therethrough. The at least one flow port may comprise an orifice. The at least one flow port may be defined by a through bore. The regulator opening arrangement may comprise a single flow port, such as a single orifice. The single flow port may be aligned with a central axis of the regulator member.

In one example the regulator opening arrangement may comprise a plurality of flow ports extending therethrough.

When the regulator member is in its first position substantially all flow through the flow control device may be provided through the regulator opening arrangement, and thus restricted in accordance with the first restriction to flow.

When the regulator member is in its first position flow may be prevented from bypassing the regulator opening arrangement. In one example the regulator member may sealingly engage a region of the flow control device to prevent fluid bypassing the regulator opening arrangement. In one example the regulator member may sealingly engage around, for example circumferentially around, a periphery of the second opening arrangement, such that flow is restricted through the regulator opening arrangement, for example prior to exiting via the second opening arrangement.

In one example the regulator member may sealingly engage a nozzle which includes the second opening arrangement.

The regulator member may comprise a sealing arrangement to permit sealing engagement with a region of the flow control device, for example with a nozzle of the flow control device. The regulator member may comprise one or more sealing ribs. In one example the regulator member may comprise a circumferential sealing rib which is arranged to circumscribe the second opening arrangement. The circumferential sealing rib may extend outwardly, for example axially outwardly, from a surface of the regulator member. The provision of a rib may assist to maximise the pressing force against the region of the flow control device for the available pressure.

In some examples the sealing arrangement may comprise one or more sealing members, such as an O-ring. For example, a sealing member may be provided on or within a surface of the regulator member, such as within a recessed region.

When the regulator member is in its second position flow may be permitted to bypass the regulator opening arrangement. Accordingly, the effect of the regulator opening arrangement in providing any restriction to flow will be largely neutralised, with flow being restricted in accordance with the second restriction to flow, for example as provided by the second opening arrangement.

The regulator member may be provided in the form of a disk.

The regulator member may be moveable between its first and second positions by action of fluid flow. For example, the regulator member may be entrained with fluid flow. The regulator member may be moveable in accordance with a pressure differential on opposing sides of the flow control device (i.e., between internal and external regions of an associated tubular).

The regulator member may be biased towards one of the first and second positions. In one example the regulator member may be biased towards its first position. The flow control device may comprise a biasing arrangement for biasing the regulator member in a desired direction. The biasing arrangement may comprise one or more springs. In one example the biasing arrangement may comprise a wave spring.

Any bias effect provided on the regulator member will need to be overcome to facilitate movement of the regulator member in one direction. The bias effect or force may determine a required differential pressure on opposing sides of the flow control device to initiate movement of the regulator member against the bias.

In one example the body may be provided separately from the tubular and mounted thereon, for example within a bore formed in a wall of the tubular. The body may comprise a threaded connection for threaded mounting on a tubular.

In one example at least part of, and in some examples all of the body may be defined by the tubular, for example integrally formed as part of a wall of the tubular.

The tubular may form part of a wellbore completion, such as a production completion, injection completion, multipurpose completion or the like. The tubular may comprise a production tubular, injection tubular, casing, liner, tool body or the like.

The tubular may be installed in an existing construction, for example an existing wellbore. In one example the tubular, having a downhole flow control device installed therein, may be installed in an existing wellbore so as to replace an existing tubular in an existing construction. As such, retrofitting of a downhole flow control device in an existing construction may be possible.

The flow control device may define or function as an inflow control device (ICD), for example during flow in one direction. The flow control device may define or function as an outflow control device, for example during flow in an opposite direction.

In use, multiple flow control devices may be provided along a wellbore completion system, to accommodate inflow and outflow relative to the completion system. Two or more flow control devices may be configured to provide different levels of flow control. For example, two or more flow control devices may be configured to provide different individual restrictions to flow. Such different flow restrictions may be achieved by included different nozzles, regulator members or the like.

In one example the flow control device may be installed within a tubular which forms part of a wellbore system intended to accommodate sequential injection and production operations. For example, the flow control device may accommodate a period of injection, followed by a period of production, with possible further cycles as required. As defined above, different flow restrictions may be provided dependent on whether injection or production is present.

In some examples the flow control device may provide a desired restriction to flow during injection operations to provide or establish a desired injection distribution or profile. The flow control device may then provide a different desired restriction to flow for production.

The flow control device may accommodate sequential stimulation and production operations. Stimulation operations may include injection of a stimulation fluid, such as water, acid, steam or the like. Such stimulation operations may assist to improve efficiency of a subsequent production operation.

In one example the flow control device may form part of a wellbore system for providing cyclic steam stimulation (CCS) operations. Such CCS operations may be provided within vertical wellbores, for example. Applications may also exist in horizontal or deviated wells. CCS operations may include an extended period, for example multiple days, weeks or months, of injecting steam into a formation via the flow control device.

The flow control device may provide a desired restriction to steam injection. When multiple flow control devices are used each device may provide a local desired restriction to steam injection to provide a suitable injection profile into the formation.

CCS operations may involve subsequent production operations via the flow control device or devices. Individual flow control device may provide a desired local production flow restriction, which may provide a suitable production profile from the formation.

Thus, the flow control device may facilitate more balanced injection and production profiles.

In one aspect of the present disclosure there is provided a downhole flow control arrangement, comprising:

a downhole tubular; and a flow control device according to any other aspect provided in a wall of the downhole tubular.

The downhole flow control arrangement may comprise multiple flow control devices provided within the wall of the tubular. The downhole flow control arrangement may comprise multiple flow control devices axially arranged along the tubular. At least two of the flow control devices may be configured similarly, for example to each provide the same first and second restrictions to flow. At least two of the flow control devices may be configured differently, for example to provide different first and/or second restrictions to flow. Such an arrangement may be provided to establish a desired inflow and/or outflow profile relative to the tubular.

In one aspect of the present disclosure there is provided a downhole flow control method, comprising:

providing flow in a first direction through a flow control device within a wall of a tubular, wherein flow in said first direction locates a regulator member within the flow control device in a first position to provide a first restriction to flow; and subsequently providing flow in a reverse second direction through the flow control device, wherein flow in said second direction locates the regulator member in a second position to provide a second restriction to flow, wherein the first and second restrictions to flow are different.

The flow control device may be provided in accordance with any other aspect.

In one aspect of the present disclosure there is provided a downhole flow control method, comprising:

injecting a fluid into a formation via a flow control device within a wall of a tubular, wherein flow in the injection direction locates a regulator member within the flow control device in a first position to provide a first restriction to flow; and producing a fluid from the formation into the tubular via the flow control device, wherein flow in the production direction locates the regulator member in a second position to provide a second restriction to flow, wherein the first and second restrictions to flow are different.

The flow control device may be provided in accordance with any other aspect.

In one aspect of the present disclosure there is provided a downhole flow control method, comprising:

producing a fluid into a formation via a flow control device within a wall of a tubular, wherein flow in the injection direction locates a regulator member within the flow control device in a first position to provide a first restriction to flow; and injecting a fluid from the formation into the tubular via the flow control device, wherein flow in the production direction locates the regulator member in a second position to provide a second restriction to flow, wherein the first and second restrictions to flow are different.

The flow control device may be provided in accordance with any other aspect.

The injection of fluid may be provided as part of a stimulation process. The method may comprise injecting a liquid. The method may comprise injecting a gas. The method may comprise injecting a steam.

The method may be provided as part of a cyclic steam stimulation operation.

In one aspect of the present disclosure there is provided a downhole steam stimulation method, comprising:

injecting a steam into a formation via a flow control device within a wall of a tubular, wherein flow in the injection direction locates a regulator member within the flow control device in a first position to provide a first restriction to flow; and producing a fluid from the formation into the tubular via the flow control device, wherein flow in the production direction locates the regulator member in a second position to provide a second restriction to flow, wherein the first and second restrictions to flow are different.

The downhole steam stimulation method may comprise cyclically injecting steam and subsequently producing a fluid.

In one aspect of the present disclosure there is provided a downhole flow control method, comprising:

providing flow in a first direction through multiple flow control devices axially arranged within a wall of a tubular, wherein flow in said first direction locates a regulator member within each flow control device in a first position to provide a first restriction to flow; and subsequently providing flow in a reverse second direction through the flow control devices, wherein flow in said second direction locates the regulator members in a second position to provide a second restriction to flow, wherein the first and second restrictions to flow are different.

One or more of the multiple flow control devices may be provided in accordance with any other aspect.

The first restriction to flow provided by at least two flow control devices may be similar. The first restriction to flow provided by at least two flow control devices may be different.

The second restriction to flow provided by at least two flow control devices may be similar. The second restriction to flow provided by at least two flow control devices may be different.

In one aspect of the present disclosure there is provided a downhole flow control device, comprising:

a body locatable within a wall of a tubular, wherein the body defines a flow path therethrough to accommodate flow in reverse first and second directions between internal and external locations of the tubular in use;

a regulator member mounted within the body and being moveable between first and second positions in accordance with flow direction through the body, wherein the regulator member is locatable in the first position during flow through the body in the first direction to provide a first restriction to flow, and the regulator member is locatable in the second position during flow through the body in the second direction to provide a second restriction to flow.

In one example the first and second restrictions to flow are optionally different.

Features defined in relation to one aspect may be provided in combination with any other aspect.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

Figure 1:
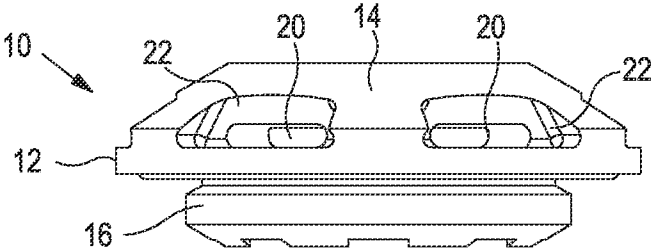
FIG. 1 is a side elevation view of a downhole flow control device.
Figure 3:
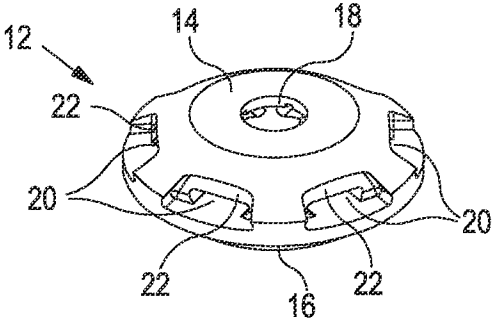
FIG. 3 is a perspective view of a body portion of the flow control device of FIG. 1.
Figure 5:
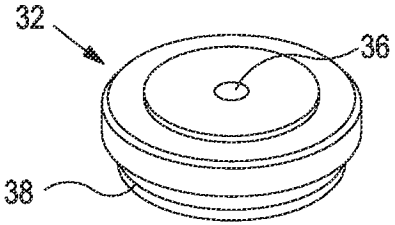
FIG. 5 is a perspective view of a regulator member of the flow control device of FIG. 1.

FIG. 1 provides a side view of a downhole flow control device, generally identified by reference numeral 10. As will be described in further detail below the device 10 may be secured within the wall of a downhole tubular, such as a completion tubular, for use in providing a degree of flow control during inflow and/or outflow relative to the tubular. In the present examples flow control includes providing a choking effect to the flow.

The flow control device 10 comprises a body 12 with an integrally formed head portion 14 and threaded portion 16 which facilitates connection within a threaded port in a wall of a tubular member, as will be described in further detail below.

Figure 2:
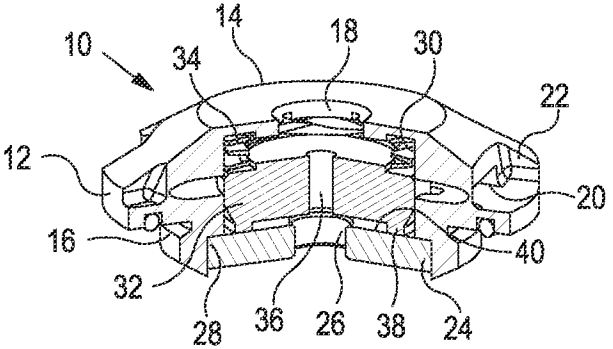
FIG. 2 is a partial cut-away perspective view of the flow control device of FIG. 1.
Figure 4:
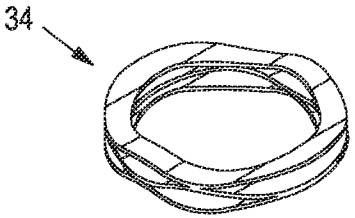
FIG. 4 is a perspective view of a spring of the flow control device of FIG. 1.
Figure 6:
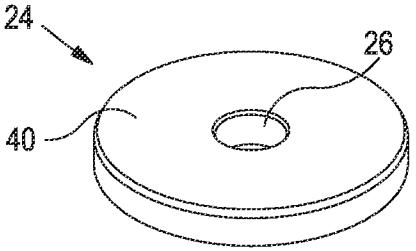
FIG. 6 is a perspective view of a nozzle of the flow control device of FIG. 1.

Reference is additionally made to FIGS. 2 to 6, wherein a partially cut-away perspective view of the device 10 is shown in FIG. 2, and individual components of the device 10 are illustrated in isolation in FIGS. 3 to 6.

The device includes a first opening arrangement comprising an array of ports, specifically a central axial port 18 and multiple radial ports 20 circumferentially arranged around the central axial port 18. The flow area defined by the ports 18, 20 of the first opening arrangement is intended to provide minimal restriction to flow. The radial flow ports 20 are provided in respective outer recessed regions 22 which provide an interface for a suitable tool, such as a wrench, to screw-tighten the device 10 into a threaded bore in a tubular.

The device 10 further comprises a nozzle disk 24 which defines a central nozzle orifice 26, wherein the nozzle disk 24 is mounted within a pocket 28 formed within the body 12. The central nozzle orifice 26 defines a second opening arrangement and the orifice size defines a restriction to flow. For the purposes of the present description the nozzle orifice 26 defines a second restriction to flow.

The body defines a cavity 30 therein which provides a flow path extending between the ports 18, 20 of the first opening arrangement and the nozzle orifice 26 of the second opening arrangement. As will be described in further detail below, the device 10 permits flow through the flow path in reverse directions.

The device 10 further comprises a regulator member or disk 32 which is moveably mounted within the cavity 30 of the body 12 between a first position, as illustrated in FIG. 2, and a second position, described and illustrated later. The regulator member 32 is biased by a circumferential wave spring 34 towards its illustrated first position. The regulator member 32 includes a regulator opening arrangement in the form of a central regulator orifice 36, wherein the orifice size defines a restriction to flow. For the purposes of the present description the regulator orifice 36 defines a first restriction to flow. In the present example the regulator orifice 36 is smaller than the nozzle orifice 26 such that the first restriction to flow defined by the regulator orifice 36 is greater than the second restriction to flow defined by the nozzle orifice 26. As will be described in more detail below, depending on the positioning of the regulator member 32 either the first or second restriction to flow will provide a controlling effect to the flow.

Figure 7:
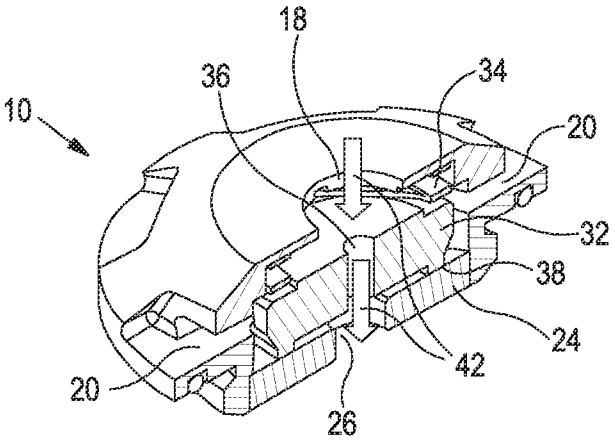
FIG. 7 is a sectional perspective view of the flow control device of FIG. 1 with flow in a first direction.

The regulator member 32 includes a circumferential rib 38 which extends axially from one side thereof. When the regulator member 32 is in the illustrated first position the rib 38 is engaged with an inner face 40 of the nozzle 24, with the rib 38 entirely circumscribing the nozzle orifice 26. The rib 38 provides a degree of sealing against the nozzle 24 such that substantially all flow through the device 10, with the regulator member 32 in the illustrated first position, is provided through the regulator orifice 36, and thus subject to the first restriction to flow. This is illustrated in FIG. 7, reference to which is now made.

In this case flow is provided in a first direction, illustrated by arrows 42, through the device 10, from the first opening arrangement (ports 18, 20), which thus function as inlets, to the second opening arrangement (orifice 26), which thus functions as an outlet. In the present example such flow in the first direction corresponds to a production direction.

During flow in the first direction the regulator member 32 is located within its first position, such that the rib 38 is engaged with the nozzle 24 to seal around the nozzle orifice 26. The positioning of the regulator member 32 in this manner is a function of the flow direction and the bias provided by the spring 34. Substantially all flow is thus provided through the regulator orifice 36. As the regulator orifice 36 is smaller than the nozzle orifice 26, the flow will thus be subject to the first restriction to flow.

Figure 8:
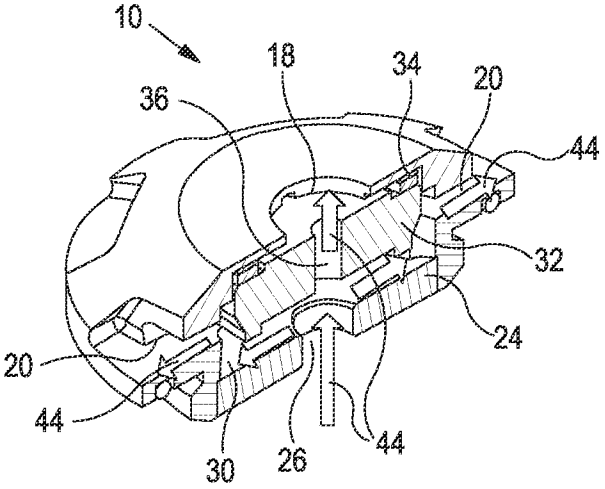
FIG. 8 is a sectional perspective view of the flow control device of FIG. 1 with flow in a reverse second direction.

FIG. 8 illustrates the device 10 during flow in a reverse second direction, illustrated by arrows 44. In the present example such flow in the second direction corresponds to flow in an injection direction. When the pressure differential to facilitate flow in the second direction is sufficient to exceed the bias provided by the spring 34, the regulator member 32 will lift from the nozzle 24 and move to a second position. As such, the spring force may dictate a required pressure differential before the device 10 will be reconfigured. The spring force may be selected in accordance with a user preference, for example in accordance with field requirements. In some examples the spring force may be selected to be equivalent to a pressure differential in the range of 0.07 to 67 bar (1 to 1,000 psi), such as between 0.34 to 51.7 bar (5 to 750 psi), for example between 0.69 to 41.37 bar (10 to 600 psi)

When the regulator member 32 is in its second position as illustrated in FIG. 8 the flow can bypass the regulator orifice 36 and flow through the cavity 30 within the body 12 before exiting via the ports 18, 20 of the first opening arrangement. Accordingly, the flow will be restricted in accordance with the second restriction to flow dictated or provided by the nozzle orifice 26.

Thus, in the present example the flow control device 10 can provide different restrictions to flow depending on flow direction, with flow in the first direction (production direction) being subject to a greater restriction than flow in the second direction (injection direction). This may permit the flow control device to be used in applications when sequential periods of production and injection are intended, without potential disadvantages of both production and injection being subject to a universal flow restriction. That is, the flow control provided by the flow control device 10 can be optimised for each of production and injection, for example by simple selection of the nozzle and regulator orifices 26, 36.

Furthermore, in the present example the regulator member 32 is autonomously reconfigured between its first and second positions to change the effective restriction to flow in accordance with changes in flow directions. This may eliminate the requirement for more complex control systems and apparatus.

Figure 9:
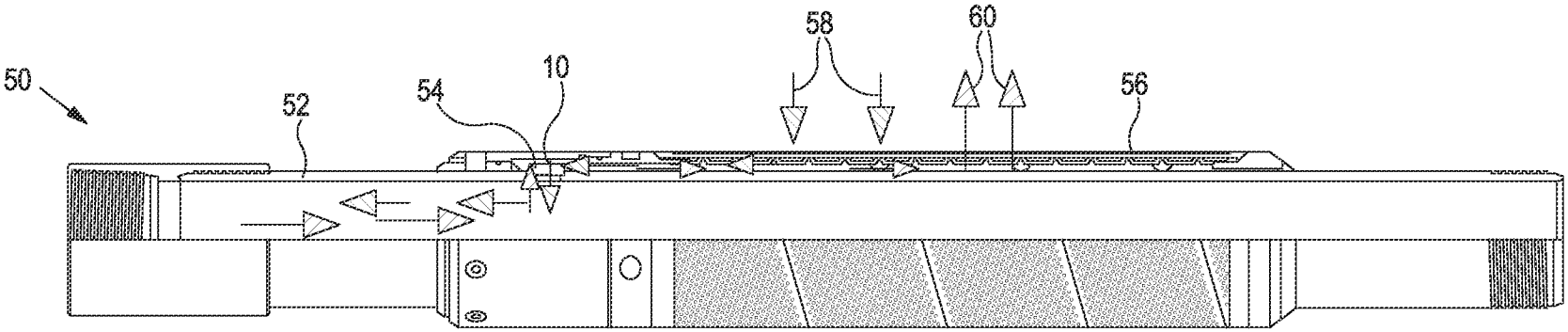
FIG. 9 is partial sectional view of a downhole tubular arrangement which incorporates a flow control device of FIG. 1.

FIG. 9 provides a part sectional view of a portion of a downhole completion arrangement 50 which incorporates the flow control device 10 first illustrated in FIG. 1. The completion arrangement includes a tubular 52 which includes a port 54 in a side wall thereof, wherein the flow control device 10 is threadedly secured within the port 54. A screen (e.g., sand screen) 56 is provided around the tubular 52, the arrangement being such that all flow to/from the tubular 52 via the flow control device 10 must pass through the screen 56 (illustrated by inflow arrows 58 and outflow arrows 60).

Although not shown multiple flow control devices 10 may be provided, arranged circumferentially around the tubular at a common axial location.

In some applications one or more flow control devices 10 may be provided at a single axial location within a wellbore completion. However, in other examples flow control devices may be distributed axially along a completion and thus wellbore. In such a case at least two of the flow control devices may provide different first and/or second restrictions to flow. This may permit preferred injection and/or production profiles to be achieved along the wellbore. An example of this will be described later.

In the example provided above the flow control device 10 functions to provide a greater restriction to production than injection. However, the reverse is possible. This may be achieved by mounting the device 10 in an inverted manner. However, in other cases some modifications may be provided, as will now be described.

Figure 10:
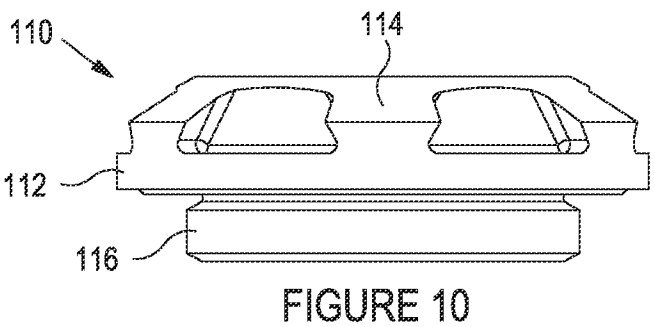
FIG. 10 is a side elevation view of an alternative downhole flow control device.
Figure 15:
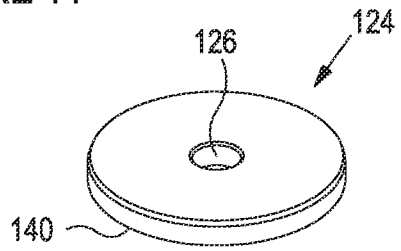
FIG. 15 is a perspective view of a nozzle of the flow control device of FIG. 10.
Figure 14:
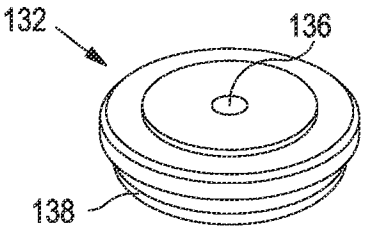
FIG. 14 is a perspective view of a regulator member of the flow control device of FIG. 10.
Figure 13:
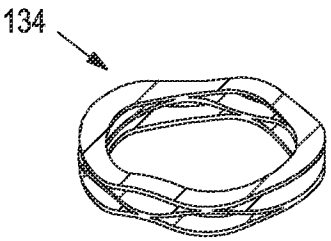
FIG. 13 is a perspective view of a spring of the flow control device of FIG. 10.
Figure 12:
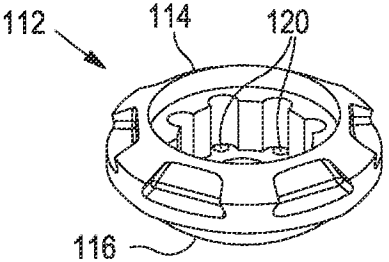
FIG. 12 is a perspective view of a body portion of the flow control device of FIG. 10.

FIG. 10 provides a side view of a downhole flow control device, generally identified by reference numeral 110. Device 110 is similar in many respects to device 10 first shown in FIG. 1 and as such like features share like reference numerals, incremented by 100. As in the earlier example, the device 110 may be secured within the wall of a downhole tubular, such as a completion tubular, for use in providing a degree of flow control during inflow and/or outflow relative to the tubular. In the present examples flow control includes providing a choking effect to the flow.

The flow control device 110 comprises a body 112 with an integrally formed head portion 114 and threaded portion 116 which facilitates connection within a threaded port in a wall of a tubular member, for example within tubular member 52 of FIG. 9.

Figure 11:
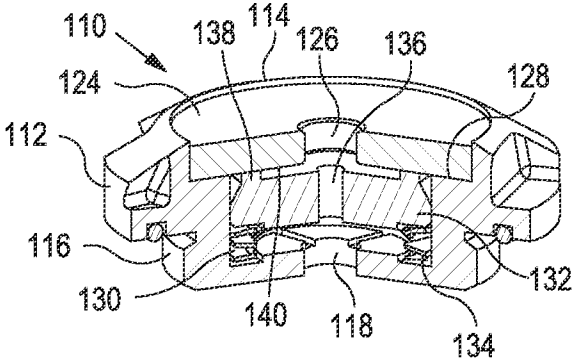
FIG. 11 is a partial cut-away perspective view of the flow control device of FIG. 10.

Reference is additionally made to FIGS. 11 to 15, wherein a partially cut-away perspective view of the device 110 is shown in FIG. 11, and individual components of the device 110 are illustrated in isolation in FIGS. 12 to 15.

The device 110 includes a first opening arrangement comprising an array of axial ports, specifically a central port 118 and multiple surrounding ports 120 (see FIG. 12) circumferentially arranged around the central port 118. The flow area defined by the ports 118, 120 of the first opening arrangement is intended to provide minimal restriction to flow.

The device 110 further comprises a nozzle disk 124 which defines a central nozzle orifice 126, wherein the nozzle disk 124 is mounted within a pocket 128 formed within the body 112. The central nozzle orifice 126 defines a second opening arrangement and the orifice size defines a restriction to flow. For the purposes of the present description the nozzle orifice 126 defines a second restriction to flow.

The body defines a cavity 130 therein which provides a flow path extending between the ports 118, 120 of the first opening arrangement and the nozzle orifice 126 of the second opening arrangement. As will be described in further detail below, the device 110 permits flow through the flow path in reverse directions.

The device 110 further comprises a regulator member or disk 132 which is moveably mounted within the cavity 130 of the body 112 between a first position, as illustrated in FIG. 11, and a second position, described and illustrated later. The regulator member 132 is biased by a circumferential wave spring 134 towards its illustrated first position. The regulator member 132 includes a regulator opening arrangement in the form of a central regulator orifice 136, wherein the orifice size defines a restriction to flow. For the purposes of the present description the regulator orifice 136 defines a first restriction to flow. In the present example the regulator orifice 136 is smaller than the nozzle orifice 126 such that the first restriction to flow defined by the regulator orifice 136 is greater than the second restriction to flow defined by the nozzle orifice 126. As will be described in more detail below, depending on the positioning of the regulator member 136 either the first or second restriction to flow will provide a controlling effect to the flow.

Figure 16:
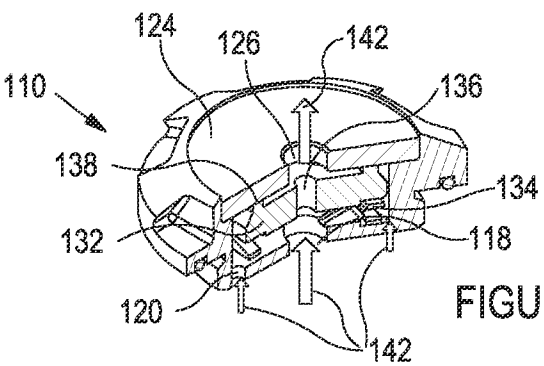
FIG. 16 is a sectional perspective view of the flow control device of FIG. 10 with flow in a first direction.

The regulator member 132 includes a circumferential rib 138 which extends axially from one side thereof. When the regulator member 132 is in the illustrated first position the rib 138 is engaged with an inner face 140 of the nozzle 124, with the rib 138 entirely circumscribing the nozzle orifice 126. The rib 138 provides a degree of sealing against the nozzle 124 such that substantially all flow through the device 110, with the regulator member 132 in the illustrated first position, is provided through the regulator orifice 136, and thus subject to the first restriction to flow. This is illustrated in FIG. 16, reference to which is now made.

In this case flow is provided in a first direction, illustrated by arrows 142, through the device 110, from the first opening arrangement (ports 118, 120), which thus function as inlets, to the second opening arrangement (orifice 126), which thus functions as an outlet. In the present example such flow in the first direction corresponds to an injection direction.

During flow in the first direction the regulator member 132 is located within its first position, such that the rib 138 is engaged with the nozzle 124 to seal around the nozzle orifice 126. The positioning of the regulator member 132 in this manner is a function of the flow direction and the bias provided by the spring 134. Substantially all flow is thus provided through the regulator orifice 136. As the regulator orifice 136 is smaller than the nozzle orifice 126, the flow will thus be subject to the first restriction to flow.

Figure 17:
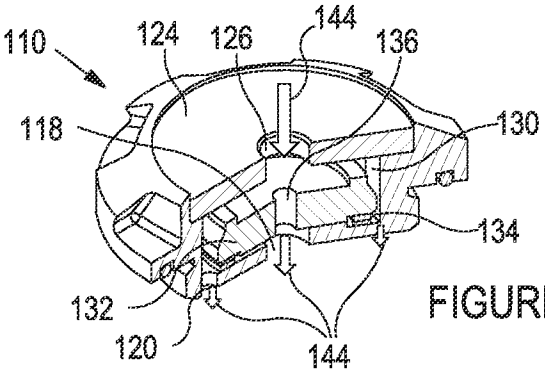
FIG. 17 is a sectional perspective view of the flow control device of FIG. 10 with flow in a reverse second direction.

FIG. 17 illustrates the device 110 during flow in a reverse second direction, illustrated by arrows 144. In the present example such flow in the second direction corresponds to flow in a production direction. When the pressure differential to facilitate flow in the second direction is sufficient to exceed the bias provided by the spring 134, the regulator member 132 will lift from the nozzle 124 and move to a second position. As such, the spring force may dictate a required pressure differential before the device 110 will be reconfigured, in the same manner as described above in relation to device 10.

When the regulator member 132 is in its second position as illustrated in FIG. 17 the flow can bypass the regulator orifice 136 and flow through the cavity 130 within the body 112 before exiting via the ports 118, 120 of the first opening arrangement. Accordingly, the flow will be restricted in accordance with the second restriction to flow dictated or provided by the nozzle orifice 126.

Figure 19:
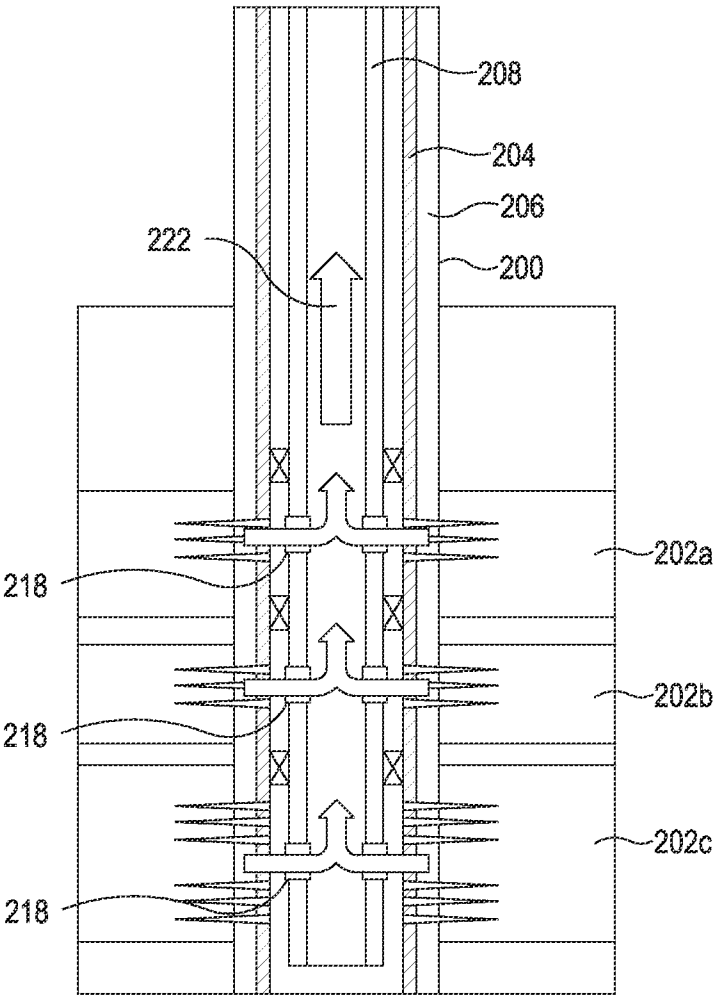
FIG. 19 is a diagrammatic illustration of the wellbore of FIG. 18, supporting subsequent production.

Examples of flow control devices according to the present disclosure may be used in numerous applications. One exemplary application will now be described with reference to FIGS. 18 and 19, which diagrammatically illustrate sequential stages of a cyclic steam stimulation (CCS) process.

Figure 18:
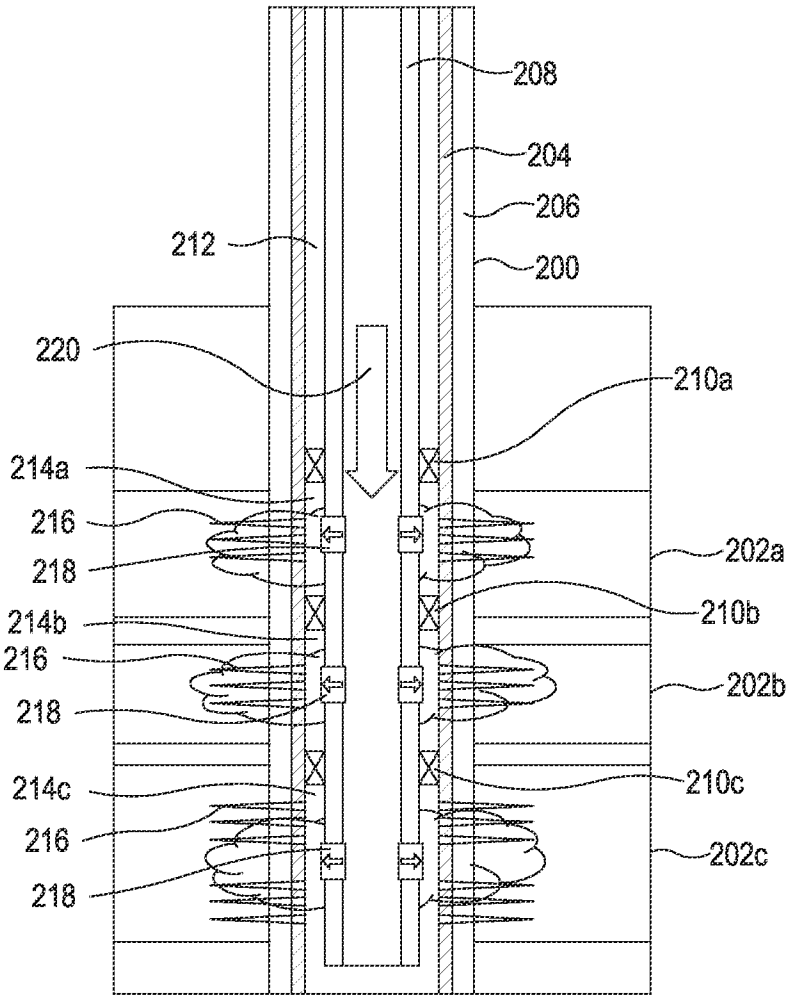
FIG. 18 is a diagrammatic illustration of a wellbore supporting an injection operation, specifically injection of steam as part of a cyclic steam stimulation operation.

Referring initially to FIG. 18 a wellbore, in this case a vertical wellbore 200, extends through multiple formation zones 202*a, b, c* which may contain heavy oil components which might be otherwise difficult to produce. The wellbore 200 is lined with casing/liner tubing 204 using cement 206, and a completion 208 string is deployed within the casing/liner 204. The completion string 208 includes a number of axially spaced packers 210*a, b, c* which provide seals in the annulus 212 formed between the completion string 208 and casing/liner 204 to define individual isolated zones 214*a, b, c*. The casing/liner 204 and cement 206 are perforated 216 in each zone 214*a, b, c* to provide communication between the isolated annulus zones 214*a, b, c* and respective formation zones 202*a, b, c*. The completion string 208 includes a number of flow control devices 218 provided within each zone 214*a*, 214*b*, 214*c*, wherein the flow control devices 218 may be provided in accordance with any of the previous flow control devices 10, 110 described herein.

When all matters concerning well completion are finalised, steam is injected through the completion string 208, identified by arrow 220, and into the formation zones 202*a, b, c* via the flow control devices 218. The flow control devices 218 are configured such that during injection the restriction to flow in each zone provides a desired injection profile across the entire formation. In the present example the restriction to flow in the injection direction is intended to substantially evenly balance the injection of steam across the zones, to thus provide a uniform heating effect. Such a balanced profile may be achieved by providing a different flow restriction effect in each zone, or indeed, if it provides the desired balancing effect, having at least two zones with the same restriction to flow.

Steam injection may be performed for a desired period, which may be a number of days, weeks or months, to heat the resident mineral resource within the formation zones 202*a, b, c* and improve their mobility. Steam injection may be ceased and production initiated, as illustrated by arrow 222 in FIG. 19, with production from each formation zone 202*a, b, c* being achieved through the flow control devices 218. As described previously, the change in flow direction will have the effect of reconfiguring the flow control devices 218 to provide a different restriction to flow. The flow control devices 218 are configured such that during production the restriction to flow in each zone provides a desired production profile across the entire formation. In the present example the restriction to flow in the production direction is intended to substantially evenly balance the production from the different formation zones 202*a, b, c*. Such a balanced profile may be achieved by providing a different flow restriction effect in each zone, or indeed, if it provides the desired balancing effect, having at least two zones with the same restriction to flow.

In alternative examples the desired injection and/or production profiles may be desirably unbalanced, and the various flow restrictions provided by the flow control devices 218 in each zone may be selected accordingly.

It should be understood that the examples described herein are merely exemplary and that various modifications may be made thereto, without departing from the scope of the present disclosure.

The invention claimed is:

1. A downhole flow control device, comprising:

a body locatable within a wall of a tubular, wherein the body defines a flow path therethrough to accommodate flow in reverse first and second directions between internal and external locations of the tubular in use;

a regulator member mounted within the body and being moveable between first and second positions in accordance with flow direction through the body, wherein the regulator member is locatable in the first position during flow through the body in the first direction to provide a first restriction to flow, and the regulator member is locatable in the second position during flow through the body in the second direction to provide a second restriction to flow, wherein the first and second restrictions to flow are different; and an opening arrangement for permitting flow into or from the flow path of the body according to flow direction, wherein the opening arrangement provides the second restriction to flow and is provided on a replaceable nozzle mounted on the body, wherein the replaceable nozzle is configured to sealingly engage the regulator member in the first position.

2. The downhole flow control device according to claim 1, wherein the first restriction to flow is larger than the second restriction to flow.

3. The downhole flow control device according to claim 1, wherein the regulator member is located within a pocket formed within the body, said pocket defining at least part of the flow path through the body.

4. The downhole flow control device according to claim 1, comprising a further opening arrangement for permitting flow into or from the flow path of the body according to flow direction, wherein the further opening arrangement defines a fluid inlet during flow in the first direction, and a fluid outlet during flow in the second direction.

5. The downhole flow control device according to claim 4, wherein the further opening arrangement comprises at least one flow port.

6. The downhole flow control device according to claim 5, wherein the at least one flow port is provided in a recessed region, wherein the recessed region provides an interface for a tool.

7. The downhole flow control device according to claim 6, wherein the regulator member comprises a regulator opening arrangement providing fluid communication through the regulator member and when the regulator member is in its first position the regulator member sealingly engages around a periphery of the opening arrangement, such that flow is restricted through the regulator opening arrangement.

8. The downhole flow control device according to claim 4, wherein the further opening arrangement defines a lower restriction to flow than both the first and second restrictions to flow.

9. The downhole flow control device according to claim 4, wherein the further opening arrangement comprises an array of flow ports arranged in a radial configuration.

10. The downhole flow control device according to claim 1, wherein the opening arrangement defines a fluid outlet during flow in the first direction, and a fluid inlet during flow in the second direction.

11. The downhole flow control device according to claim 10, wherein the opening arrangement comprises at least one flow port.

12. The downhole flow control device according to claim 1, wherein the regulator member comprises a regulator opening arrangement providing fluid communication through the regulator member.

13. The downhole flow control device according to claim 12, wherein the regulator opening arrangement provides the first restriction to flow.

14. The downhole flow control device according to claim 12, wherein the regulator opening arrangement comprises at least one flow port.

15. The downhole flow control device according to claim 12, wherein when the regulator member is in its first position substantially all flow through the flow control device is provided through the regulator opening arrangement, and thus restricted in accordance with the first restriction to flow.

16. The downhole flow control device according to claim 12, wherein the regulator member sealingly engages a region of the flow control device to prevent fluid bypassing the regulator opening arrangement when the regulator member is in its first position.

17. The downhole flow control device according to claim 12, wherein the regulator member comprises a sealing arrangement to permit sealing engagement with a region of the flow control device.

18. The downhole flow control device according to claim 12, wherein when the regulator member is in its second position flow is permitted to bypass the regulator opening arrangement.

19. The downhole flow control device according to claim 1, wherein the regulator member is biased towards one of the first and second positions.

20. The downhole flow control device according to claim 1, comprising a biasing arrangement for biasing the regulator member in a desired direction, wherein the biasing arrangement defines a required differential pressure on opposing sides of the flow control device to initiate movement of the regulator member against the bias.

21. A downhole flow control arrangement, comprising:

a downhole tubular; and a flow control device according to claim 1 provided in a wall of the downhole tubular.

22. A downhole flow control method, comprising:

providing flow in a first direction through a flow control device within a wall of a tubular, wherein flow in said first direction locates a regulator member within the flow control device in a first position to provide a first restriction to flow; and subsequently providing flow in a reverse second direction through the flow control device, wherein flow in said second direction locates the regulator member in a second position to provide a second restriction to flow, wherein the first and second restrictions to flow are different;

wherein the flow control device comprises an opening arrangement for permitting flow into or from a flow path of a body according to flow direction, wherein the opening arrangement provides the second restriction to flow and is provided on a replaceable nozzle mounted on the body, wherein the replaceable nozzle sealingly engages the regulator member in the first position.

23. A downhole flow control method, comprising:

injecting a fluid into a formation via a flow control device within a wall of a tubular, wherein flow in an injection direction locates a regulator member within the flow control device in a first position to provide a first restriction to flow;

producing a fluid from the formation into the tubular via the flow control device, wherein flow in a production direction locates the regulator member in a second position to provide a second restriction to flow, wherein the first and second restrictions to flow are different;

wherein the flow control device comprises an opening arrangement for permitting flow into or from a flow path of a body according to flow direction, wherein the opening arrangement provides the second restriction to flow and is provided on a replaceable nozzle mounted on the body, wherein the replaceable nozzle sealingly engages the regulator member in the first position.

24. A downhole flow control method, comprising:

providing flow in a first direction through multiple flow control devices axially arranged within a wall of a tubular, wherein flow in said first direction locates a regulator member within each flow control device in a first position to provide a first restriction to flow; and subsequently providing flow in a reverse second direction through the flow control devices, wherein flow in said second direction locates the regulator members in a second position to provide a second restriction to flow, wherein the first and second restrictions to flow are different;

wherein the flow control device comprises an opening arrangement for permitting flow into or from a flow path of a body according to flow direction, wherein the opening arrangement provides the second restriction to flow and is provided on a replaceable nozzle mounted on the body, wherein the replaceable nozzle sealingly engages the regulator member in the first position.

* * * * *